US010777401B2

(12) United States Patent
Wolf

(10) Patent No.: US 10,777,401 B2
(45) Date of Patent: Sep. 15, 2020

(54) USE OF AN IONIZING DEVICE, DEVICE AND METHOD FOR IONIZING A GASEOUS SUBSTANCE AND DEVICE AND METHOD FOR ANALYZING A GASEOUS IONIZED SUBSTANCE

(71) Applicant: PLASMION GMBH, Augsburg (DE)

(72) Inventor: Jan-Christoph Wolf, Ingolstadt (DE)

(73) Assignee: PLASMION GMBH, Augsburg (DE)

( * ) Notice: Subject to any disclaimer, the term of this patent is extended or adjusted under 35 U.S.C. 154(b) by 0 days.

(21) Appl. No.: 16/062,932

(22) PCT Filed: Dec. 14, 2016

(86) PCT No.: PCT/IB2016/057626
§ 371 (c)(1),
(2) Date: Jun. 15, 2018

(87) PCT Pub. No.: WO2017/103819
PCT Pub. Date: Jun. 22, 2017

(65) Prior Publication Data

US 2018/0366310 A1 Dec. 20, 2018

(30) Foreign Application Priority Data

Dec. 17, 2015 (DE) ..... 10 2015 122 155

(51) Int. Cl.
*H01J 49/00* (2006.01)
*H01J 49/10* (2006.01)
*H05H 1/24* (2006.01)

(52) U.S. Cl.
CPC ..... *H01J 49/105* (2013.01); *H01J 49/0031* (2013.01); *H05H 1/2406* (2013.01);
(Continued)

(58) Field of Classification Search
USPC ..... 250/282
See application file for complete search history.

(56) References Cited

U.S. PATENT DOCUMENTS 4,501,965 A 2/1985 Douglas
4,948,962 A 8/1990 Mitsui et al.
(Continued)

FOREIGN PATENT DOCUMENTS

CN 103177928 6/2013
CN 104064429 A 9/2014
(Continued)

OTHER PUBLICATIONS

Kogelschatz; et. al Dielectric-Barrier Discharges. Principle and Applications. Journal de Physique IV Colloque, 1997, 07 (C4), pp. C4-47-C4-66 (Year: 1997).*
(Continued)

*Primary Examiner* — Phillip A Johnston
(74) *Attorney, Agent, or Firm* — Greenberg Traurig LLP

(57) ABSTRACT

The present invention relates to the technical field of ionizing a gaseous substance, in particular the ionizing or ionization of a gaseous substance in preparation for its analysis. A device is intended to make a discharge gas and a test substance ionizable in a flow-through mode without essentially destroying or fragmenting the sample substance. In order to avoid a high expenditure in terms of construction and equipment, the device is intended to be usable under ambient conditions and to ensure a high sensitivity in a possible analysis of an ionized substance. To this end, an ionizing device is used for flow-through ionization of a discharge gas and of a sample substance at an absolute pressure of more than 40 kPa in the ionizing device during ionization. The ionizing device comprises an inlet, an outlet, a first electrode, a dielectric element and a second electrode. The dielectric element is configured in the shape of a hollow body having an inner side and an outer side and it allows a flow of the discharge gas and of the sample substance therethrough in a flow direction. The first electrode is
(Continued)

arranged outside of the outer side of the dielectric element. The second electrode is arranged, at least sectionwise, inside the dielectric element, is surrounded by the inner side of the dielectric element perpendicularly to the flow direction, and allows a flow of the discharge gas and of the sample substance therethrough or therearound. A distance in or contrary to the flow direction exists between the associated ends of the first and second electrodes and lies between −5 mm to 5 mm. A dielectric barrier discharge is establishable in a dielectric barrier discharge region by applying a voltage between the first and second electrodes so as to ionize the discharge gas or the sample substance.

24 Claims, 11 Drawing Sheets

(52) U.S. Cl.
CPC ..... *H05H 2001/245* (2013.01); *H05H 2001/2412* (2013.01); *H05H 2001/2431* (2013.01)

(56) References Cited

U.S. PATENT DOCUMENTS 5,252,827 A 10/1993 Koga et al.
5,961,772 A 10/1999 Selwyn
6,320,388 B1 * 11/2001 Sun ..... G01N 27/66 250/281
6,407,382 B1 6/2002 Spangler
6,410,914 B1 6/2002 Park et al.
6,646,256 B2 11/2003 Gourley et al.
7,005,635 B2 2/2006 Ahern et al.
7,095,019 B1 8/2006 Sheehan et al.
7,119,330 B2 10/2006 Kalinitchenko
7,256,396 B2 8/2007 Reilly
7,667,197 B2 * 2/2010 Lin ..... H01J 49/12 250/281
7,807,964 B2 * 10/2010 Li ..... H01J 49/067 250/287
7,910,896 B2 3/2011 Marta et al.
8,247,784 B2 8/2012 Neidholdt et al.
8,368,013 B2 * 2/2013 Ishimaru ..... H01J 49/145 250/281
8,696,996 B2 * 4/2014 Albrecht ..... A61L 9/22 422/186.04
8,772,710 B2 7/2014 Ouyang et al.
8,803,084 B2 * 8/2014 Nishimura ..... H05H 1/2406 250/288
2003/0070913 A1 4/2003 Miller et al.
2007/0007448 A1 1/2007 Wang
2007/0114389 A1 5/2007 Karpetsky et al.
2008/0048107 A1 2/2008 McEwen
2010/0032559 A1 2/2010 Lopez-Avila et al.
2010/0301199 A1 12/2010 Chen et al.
2011/0108726 A1 5/2011 Hiraoka et al.
2011/0168881 A1 7/2011 Sturgeon et al.
2011/0253889 A1 10/2011 Ishimaru
2012/0292501 A1 5/2012 Sugiyama
2012/0292526 A1 11/2012 Hiraoka et al.
2014/0011282 A1 1/2014 Ouyang et al.
2014/0331861 A1 11/2014 Makarov et al.
2015/0069254 A1 3/2015 Fernandez et al.

FOREIGN PATENT DOCUMENTS

EP 2450942 A2 5/2012
WO 2009102766 8/2009
WO 2015077879 6/2015

OTHER PUBLICATIONS

PCT International Search Report, International Application No. PCT/IB2016/057626, dated Mar. 15, 2017, pp. 1-2.
S. Liu et al., Excitation of dielectric barrier discharges by unipolar submicrosecond square pulses, J. Phys. D: Appl. Phys. 34 (2001) 1632-1638.
M. M. Nudnova et al., Active capillary plasma source for ambient mass spectrometry; Rapid Commun. Mass Spectrom. 26 (2012) 1447-1452.
Z. Wu et. al., An Atmospheric Press Dielectric-barrier Discharge and ist Application for Detection of Environmental Pollutants, Advances in Biomedical Engineering 6 (2012) 133-139.
M. Sugiyama et al., Sensitive low-pressure dielectric barrier discharge ion source; Rapid Commun. Mass Spectrom. 27 (2013) 1005-1010.
L. Bregy et al., Real-time breath analysis with active capillary plasma inonization-ambient mass spectrometry, J. Breath Res. 8 (2014) 1-8.
J.-C. Wolf et al., Direct gas-phase detection of nerve and blister warfare agents utilizing active capillary plasma ionization mass spectrometry, Eur. J. Mass Spectrom. 21 (2015) 1-8.
J.-C. Wolf et al., Direct Quantification of Chemical Warfare Agents and Related Compounds at Low ppt Levels: Comparing Active Capillary Dielectric Barrier Discharge Plasma Ionization and Secondary Electrospray Ionization Mass Spectrometry, Anal. Chem. 87 (2015) 723-729.

* cited by examiner

Section A-A

USE OF AN IONIZING DEVICE, DEVICE AND METHOD FOR IONIZING A GASEOUS SUBSTANCE AND DEVICE AND METHOD FOR ANALYZING A GASEOUS IONIZED SUBSTANCE

This application is a National Stage Application of PCT Application No. PCT/IB2016/057626, filed Dec. 14, 2016, which claims priority to DE Patent Application No. 10 2015 122 155.1, filed Dec. 17, 2015. The disclosures of each of these documents is hereby incorporated by reference in its entirety.

The invention relates to the technical field of ionizing a gaseous substance, in particular the ionizing or ionization of a gaseous substance in preparation for its analysis.

WO 2009/102766 describes a plasma probe ionizing a discharge gas through a dielectric barrier discharge. For ionizing a sample substance, the plasma probe is directed at a sample substance so as to ionize the sample substance. The ionized sample substance can be analyzed in a mass analysis unit arranged close to the sample substance. This kind of ionization leads to a repulsion of charged particles and to collisions with gas molecules, whereby a discharge can take place. This leads to a substantial loss of ions before the analysis and thus to a reduced sensitivity.

US 2013/0161507 A1 l discloses a mass spectrometer using, for the purpose of ionizing an analyte, the technique of dielectric barrier discharge. The published application especially aims at accomplishing a low voltage for discharge between two electrodes (cf. page 1, [0009]). To this end, a sample 101 to be analyzed has to be placed in a sample vessel 106 and enters due to a pressure gradient under vacuum a discharge area 114, where the ionization takes place. In the discharge area a pressure between 2 Torr and 300 Torr (between 266 Pa and 39900 Pa) prevails, the distance between the electrodes 112, 113 being between 1 mm and 100 mm (cf. page 2, [0035]). The vacuum in the discharge area 114 is necessary for achieving a low discharge voltage. In addition, a light illumination unit 116 is used, which irradiates an area and generates a discharge. Such a device (under vacuum) has a complex structural design and the necessity of placing a sample into the sample vessel allows an application only in the case of certain analyses.

It is the object of the present invention to provide a device, which is adapted to be used for ionizing a discharge gas and a sample substance in a flow-through mode without essentially destroying (fragmenting) the sample substance, which is usable under ambient conditions so as to avoid a high expenditure in terms of construction and equipment, and which ensures a high sensitivity in a possible analysis of an ionized substance.

This object is achieved by the use of an ionizing device, an ionizing device, which is adapted for use in an ionizing method and for the purpose of flow-through ionization. An analysis unit makes an ionized sample substance analyzable in an analyzer according to an analysis method.

The ionizing device or ionization device comprises at least two electrodes separated by a dielectric element. The dielectric element has the shape of a hollow body, so that a discharge gas and a sample substance can flow through the element. Outside the dielectric element a first electrode is arranged. The first electrode may be configured as a ring or as a hollow cylinder and may be pushed over the dielectric element or applied thereto. The second electrode is arranged inside the dielectric element. When a sufficiently high AC voltage is applied to one or both of the electrodes, a dielectric barrier discharge will be caused in a dielectric discharge region of the ionizing device. The ionization of gaseous substances takes place in and/or after the dielectric discharge region.

Surprisingly enough, it turned out that the ionizing efficiency or ionization efficiency depends to a considerable extent on the arrangement of the electrodes relative to one another, whereby, through an advantageous arrangement, the sensitivity of a possible subsequent analysis can be increased substantially. For a high ionization efficiency, the distance between the associated ends of the electrodes is between −5 mm and 5 mm (a detailed representation of the distance is is shown in FIG. 1*a* to 1*c*).

It will also be advantageous when the electrodes are spaced apart at a small distance perpendicularly to the direction of flow, but, taking into account the influence on the dielectric discharge that can take place between at least two electrodes, this distance may be configured in different ways.

Equally surprising is a highly efficient ionization of gaseous substances at a pressure of more than 40 kPa in the discharge area. The vacuum can be provided by a vacuum unit arranged at the outlet of the ionizing device.

The success desired and achieved by the present invention is the flow-through ionization of a sample substance for analysis. A so-called "soft" ionization is here used, which for the most part does not destroy or fragment the molecules, but leads to quasi-molecular ions through protonation and charge-transfer reactions. Especially in connection with (high-resolution) mass spectrometry, the substance can here be identified directly via its element composition. Due to the way in which the ionizing device and the ionizing method according to the present invention are configured, a very high sensitivity in the low femtogram to attogram range is achieved during a subsequent analysis.

The invention provides a highly efficient ionizing device (and a method associated therewith), which, in combination with mass spectrometry or ion mobility spectrometry, provides a highly sensitive "electronic nose" (in an analysis method) allowing a direct chemical analysis of molecules in the gaseous phase. Application possibilities are, in addition to classical combinations with chromatographic methods (GC, HPLC, Nano-LC), also direct screening analyses, e.g. a direct pesticide analysis on fruit or vegetable surfaces. For military or civil defense purposes, the technology may be used to detect toxic compounds or warfare agents. Especially in the case of chemical warfare agents, a very high sensitivity is required, since even the smallest concentrations of these agents may lead to poisoning that is dangerous to life. Another related field of application is forensics or security checks (narcotic or explosive wipe tests). Also a combination with sample preconcentration systems such as SPME is possible. The method can be used for medical "point of care" diagnostics (e.g. biomarker analysis in breath or in combination with SPME for hazardous and prohibited substances in blood, urine etc.).

The possibility of flow-through ionization simplifies sampling during analysis in general ("sucking in" analogously to the human nose), and this is important for rapid analysis applications or screening analyses, e.g. in industrial process control. Furthermore, the hitherto existing problem of an effective transfer of charged particles at atmospheric pressure into a vacuum (analysis) is solved. Due to the mutual repulsion of the charged particles, large parts of the ions formed are lost without being used in currently used processes for atmospheric is pressure ionization (e.g. ESI, HEST, APCI, DART, DESI, LTP). The formation of ions directly in or at the inlet guarantees an effective transfer of the charged particles for analysis and thus a high sensitivity.

Chemical analyses usually have to be carried out not only qualitatively but also quantitatively. Due to the problem of an "open" connection between the ionization and the analyzer, as with existing methods, the quantification can easily be interfered with by external influences (drafts, diffusion of impurities, etc.). This entails the problem of wrong or incorrect analysis results. Through a flow-through ionization, the connection between ionization and analyzer is closed and the above-described problem arising with respect to quantification is solved in this way.

Existing plasma-based ionization processes at quasi atmospheric pressure do not allow the analyte to be introduced into the discharge gas, since the analyte is destroyed in the discharge. This problem is solved by the formation of an extremely "soft" plasma with little or no fragmentation.

Just like the efficiency, the degree of fragmentation occurring depends partly on the composition of the surrounding atmosphere (humidity, etc.). Thus, a suitable selection of additive compounds (dopants) or gas compositions will allow to reduce or increase the ionization efficiency and/or fragmentation. The latter is particularly useful for portable applications, since portable systems themselves are usually not able to generate characteristic fragments that are used to identify the substances.

Furthermore, the invention allows a miniaturization of analysis devices and can be combined with portable systems, whereby the sensitivity of the latter is substantially increased. In addition, operation with batteries or rechargeable batteries is possible. No operating materials (except electrical energy) are required and analyses can be carried out in less than 100 ms. Furthermore, due to the miniaturizability and the structural design of the present invention, the invention can be combined with other, already existing ionization methods (e.g. ESI, APCI, etc.), thus allowing simultaneous detection of different analytes, such as the parallel ionization of very polar and non-polar substances.

A further development of the ionizing device comprises the introduction of so-called "dopant" substances (e.g. in chemical ionization) upstream or downstream of the ionizing device, for the purpose of increasing the selectivity or the sensitivity.

The ionizing device allows carrying out an efficient ionization in the dielectric barrier discharge region even at a pressure higher than 60 kPa, preferably higher than 80 kPa and particularly preferred at an essentially atmospheric pressure.

The distance between the associated ends of the first and second electrodes lies preferably between −3 mm and 3 mm, more preferably between −1 mm and 1 mm, particularly preferred is between −0.2 mm and 0.2 mm, and most preferably between −0.05 mm and 0.05 mm for a particularly high efficiency of ionization through a dielectric barrier discharge.

The second electrode, which is, at least sectionwise, arranged inside the dielectric element, may have the shape of a hollow cylinder or may be configured as a hollow body having a non-circular base area. Suitable basic shapes of a hollow body additionally comprise a triangular, a rectangular or an oval basic shape. The second electrode may also be configured as a wire that is arranged concentrically or eccentrically to the dielectric element. A small distance between the second electrode perpendicular to the direction of flow of the gaseous substances and the dielectric element will be advantageous. In particular, the distance is smaller than 0.5 mm and preferably smaller than 0.1 mm. Particularly good ionization results are achieved, when the second electrode is in contact with the inner side of the dielectric element.

The first electrode may be spaced apart from the dielectric element perpendicularly to the flow direction of the gaseous substances, the distance being preferably smaller than 5 mm. In particular, the second electrode is in contact with the outer side of the dielectric element. The best ionization results will be achieved when the first electrode is applied as a layer to the outer side of the dielectric element. In this way, parasitic discharges of the first electrode, which may also occur in the case of a (very) small distance (e.g. gas inclusions) between the first electrode and the dielectric element, can be avoided. The first electrode can be applied as a layer through a drying or curing liquid or suspension, e.g. a metal paint. The layer may also be applied to the outer side of the dielectric element through a transition from a gaseous phase into the solid phase. To this end, e.g. sputtering, CVD or PVD, or other coating techniques may be used.

The first and second electrodes are made of a conductive material (for electric current). In particular, they are made of a metal that is preferably silver or gold, contains a certain amount of silver or gold (also in the form of a layer) or consists of a metal alloy.

The dielectric element may consist of a plastic material (e.g. PMMA or PP) or preferably of quartz glass or of some other dielectric material.

The ionizing device has an inlet and an outlet. Through the inlet, a discharge gas and a sample substance can enter the ionizing device, where they can be ionized, at least partially, inside the device and from where they can exit the device through the outlet in an at least partially ionized condition. The area of the inlet through which the discharge gas and sample substance can flow is preferably larger than the flow-through area of the outlet. In particular, a flow limitation unit is arranged at the outlet of the device.

A flow through the ionizing device is preferably caused by a pressure gradient. Preferably, the pressure is higher at the inlet of the device than at the outlet of the device. Especially, the pressure prevailing at the outlet of the device is lower than atmospheric pressure while the is pressure prevailing outside the inlet is atmospheric pressure.

By arranging an analysis unit on the ionizing device, an analyzer can be established. Preferably, the ionizing device is directly connected to the analysis unit (optionally via a short intermediate element). The analysis unit is preferably a unit that is capable of carrying out an analysis on the basis of a molecular charge, e.g. a mass spectrometer, an ion mobility spectrometer or similar devices.

Preferably, the analyzer may have arranged therein, in addition to an ionizing device according to the present invention, at least one further ionizing device, e.g. a device for performing electron impact ionization, electrospray ionization or the like.

For an analyzer having a particularly simple structural design, the inlet of the ionizing device is open to the surroundings and the discharge gas is the atmosphere surrounding the inlet, in particular air. Other discharge gases may be used as well, such as nitrogen, oxygen, methane, carbon dioxide, carbon monoxide, at least one noble gas or mixtures thereof.

According to preferred embodiments, the ionizing device or the analyzer may be miniaturized such that a portability is given (e.g. handheld devices).

The ionizing device may be used in a method by means of which a discharge gas and a sample substance are ionized, especially in a flow-through mode. First, the discharge gas and the sample substance are introduced into the ionizing device through the inlet of the ionizing device, whereupon a voltage is applied between the first and second electrodes such that a dielectric barrier discharge will be caused in a dielectric barrier discharge region, and the discharge gas and/or the sample substance will be ionized in and/or after the discharge region.

For generating the dielectric barrier discharge, a voltage of up to 20 kV may be used, preferably a maximum of 10 kV and especially a maximum of 5 kV. Particularly good ionization results are achieved with a voltage between 1 kV and 3 kV.

The dielectric barrier discharge may be caused by unipolar voltage pulses (or high-voltage pulses) in order to minimize the effects of a displacement current and suppress thus e.g. undesired fragmentation reactions. The pulses preferably have a duration of 1 μs and in particular a maximum duration of 500 ns. The best results are achieved with pulses having a duration between 100 ns and 350 ns. The impulses or pulses have here preferably a frequency that is not higher than 1 MHz, in particular not higher than 100 kHz, and particularly preferred not higher than 25 kHz. The most energy-efficient ionization results are achieved at a frequency between 1 kHz and 15 kHz.

The voltage between the first and second electrodes may be applied by a sine-wave voltage, the sine-wave voltage of one of the first and second electrodes being preferably shifted by half a period relative to that of the other one of the first and second electrodes.

An analyzer may be used in a method according to which a discharge gas and a sample substance are introduced in the inlet of an ionizing device. A voltage is applied to the first and/or second electrode such that a dielectric barrier discharge will be caused in a dielectric barrier discharge region. In and/or after the dielectric barrier discharge region, the sample substance and/or the discharge gas are ionized, at least partially, and subsequently analyzed.

A voltage of up to 20 kV, preferably not higher than 10 kV, and especially not higher than 5 kV, can be used in the analysis method. Particularly good ionization results are achieved at a voltage between 1 kV and 3 kV.

The dielectric barrier discharge in the analysis method may be caused by unipolar voltage pulses (or high-voltage pulses) in order to minimize the effects of a displacement current. The pulses preferably have a duration of 1 μs and in particular a maximum duration of 500 ns. The best results are achieved with pulses having a duration between 100 ns and 350 ns.

The impulses or pulses preferably have a frequency that is not higher than 1 MHz, in particular not higher than 100 kHz, and particularly preferred not higher than 25 kHz. The most energy-efficient ionization results are achieved at a frequency between 1 kHz and 15 kHz.

The voltage between the first and second electrodes may be applied by a sine-wave voltage, the sine-wave voltage of one of the first and second electrodes being preferably shifted by half a period relative to that of the other one of the first and second electrodes.

An ionizing device can be used for flow-through ionization of a discharge gas and a sample substance. A discharge gas, such as air or some other atmosphere surrounding the inlet of the ionizing device, can be introduced continuously into the device. A sample can be introduced into the device discontinuously or continuously together with the discharge gas. Ionization takes place inside the ionizing device in a flow-through mode. When an analysis unit is connected to the ionizing device, it can in particular be ensured that the ionized sample substance to be analyzed will enter the analysis unit without interacting with discharge gas that has not passed through the ionizing device, as would be the case e.g. with plasma jets.

According to a further embodiment, an ionizing device may have a sample inlet that is arranged (downstream) of the discharge area. The sample inlet may, for example, be configured as a T-piece.

In the case of such an embodiment, a discharge gas may be introduced through an inlet of an ionizing device, viz. the ionizing device as described above or in the following, and ionized in the discharge area. In the discharge area, a dopant may be present in addition to the discharge gas. The dopant may, like the discharge gas, be introduced via the inlet of the ionizing device, or it may be introduced in the ionizing device via an additional inlet (dopant inlet). Thus, the discharge gas and/or the dopant is/are ionized in the ionizing device. The sample introduced after (downstream) of the discharge area reacts, especially through a charge transfer reaction, with the ionized discharge gas and/or dopant, whereby the sample will be ionized. Preferably, an absolute pressure of more than 40 kPa prevails in the ionizing device during ionization.

An ionizing device of the type described above or in the following may be used in such a way that a discharge gas and/or dopant is/are present during ionization in the discharge area, the discharge gas and/or the dopant being thus ionized. Preferably, an absolute pressure higher than 40 kPa prevails during ionization in the ionizing device. The ionized discharge gas and/or the dopant can leave the ionizing device in an ionized condition and meet a sample outside the ionizing device, whereby a reaction, in particular a charge transfer reaction, will take place between the ionized discharge gas and/or the dopant and the sample. Thus, a sample can be ionized.

According to a further embodiment, an ion mass filter may be connected to an ionizing device of the type described above or in the following. Through an ion mass filter a specific ion or specific ions is/are isolated or selected based on their mass or their mass-to-charge ratio. An example of an ion mass filter is a quadrupole. The ion mass filter may be arranged between the discharge area of an ionizing device and the sample inlet of the ionizing device, provided that the ionizing device has a sample inlet.

The ion mass filter may also be arranged between the discharge area of an ionizing device and the exit or outlet of the ionizing device. By using an ion mass filter, special ions of the discharge gas and/or of the dopant can be selected, which are brought into contact with a sample, whereby an improvement of the selectivity and/or sensitivity can be accomplished during an analysis of the ionized sample.

The ionizing devices described may be used in the analyzers, methods of ionizing or methods of analyzing described above or in the following.

The embodiments of the present invention are illustrated by means of examples and not in a manner in which restrictions from the figures are transferred to or read into the claims.

FIG. 1 shows an embodiment of an ionizing device 100 in a section through the longitudinal axis in the flow direction R.

FIG. 1*a* shows an embodiment of an ionizing device 100 in a section through the longitudinal axis in the flow direction R with a positive value of the distance D.

FIG. 1*b* shows an embodiment of an ionizing device 100 in a section through the longitudinal axis in the flow direction R with a negative value of the distance D.

FIG. 1*c* shows an embodiment of an ionizing device 100 in a section through the longitudinal axis in the flow direction R with a value of the distance D equal to zero.

Figure 11:
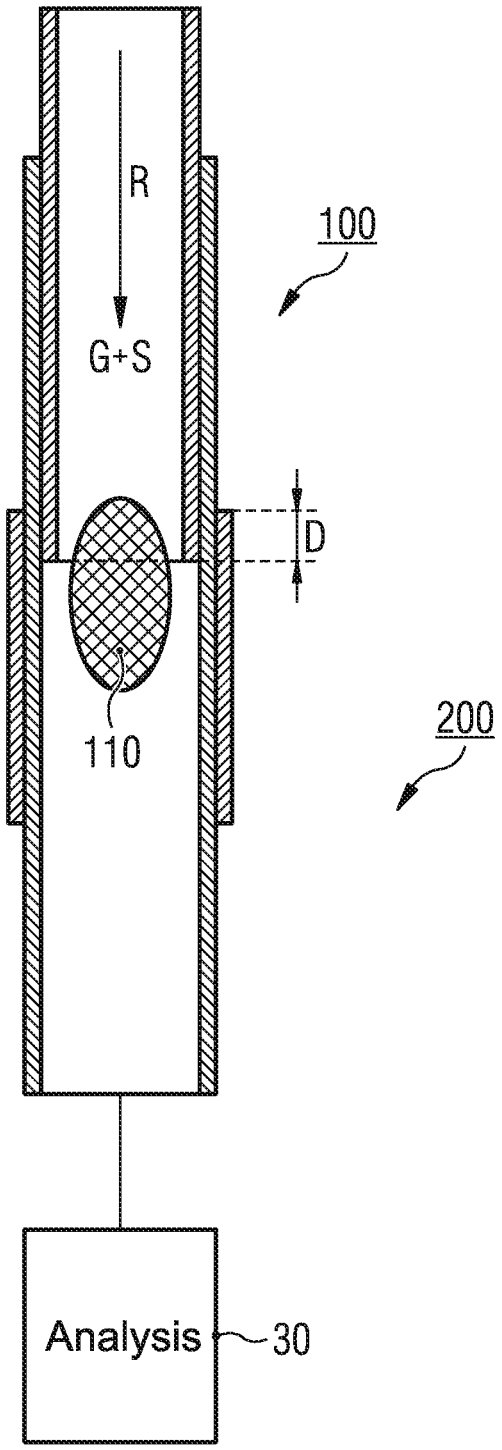

FIG. 11 shows an embodiment of an analyzer 200 in a section through the longitudinal axis in the flow direction R with an ionizing device 100 and an analysis unit 30.

Figure 1:
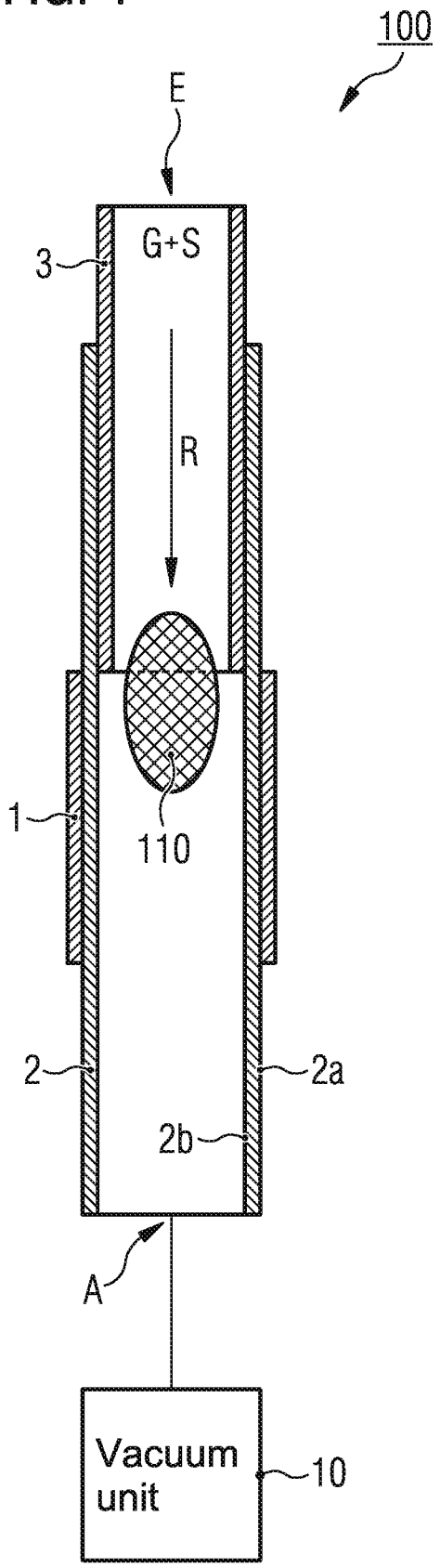

FIG. 1 shows an embodiment of an ionizing device 100 comprising a first electrode 1 that is in contact with the outer side 2*a* of a dielectric element 2. A second electrode 3 is arranged is partially inside the dielectric element 2 and is in contact with the inner side 2*b* of the dielectric element. In the present embodiment, the first and second electrodes 1, 3 and the dielectric element 2 are configured as cylindrical hollow bodies with open end faces. The outer diameter and the wall thickness of the first electrode 1 are selected such that the first electrode 1 is in contact with the dielectric element 2 and the outer diameter of the second electrode 3 is reduced in size relative to the first electrode 1 substantially by twice the wall thickness of the first electrode 1 and twice the wall thickness of the dielectric element 2. The ionizing device 100 allows a discharge gas G or a sample substance S (or a mixture of the discharge gas G and a sample substance S) to flow therethrough in a flow direction R. The discharge gas G and/or the sample substance S can enter the ionizing device 100 through the inlet E of the ionizing device 100, the inlet E being open to the surrounding atmosphere. In the present embodiment, the inlet E is defined as an area having the inner diameter of the second electrode by the open flow-through end face (contrary to the flow direction R) of the second electrode 3. According to other embodiments, the second electrode 3 may be arranged fully inside the dielectric element 2, so that the inlet E of the ionizing device 100 is defined by the open end face of the dielectric element 2, which is located in a direction opposite to the flow direction R. An outlet A of the ionizing device 100 is formed by the end face of the dielectric element 2 located in the flow direction R. The flow-through area of outlet A is determined by the inner diameter of the dielectric element 2. The first and second electrodes 1, 3 are arranged relative to one another in such a way that there is substantially no distance between them in the flow direction R. A distance of the electrodes 1, 3 perpendicular to the flow direction R results from the wall thickness of the dielectric element 2 located between the electrodes 1, 3.

At the outlet A of the ionizing device 100, a vacuum unit 10 is arranged, in which a pressure below atmospheric pressure prevails, whereby a flow is caused in the ionizing device 100 and the pressure in the ionizing device 100 is controlled (by controlling the pressure in the vacuum unit 10). A vacuum unit 10 may be arranged on all embodiments of the ionizing device 100.

When a voltage, especially an AC voltage, is applied to one or both of the electrodes 1, 3, a dielectric barrier discharge can occur in a dielectric barrier discharge region 110 so as to ionize a discharge gas G or the sample substance S. The dielectric barrier discharge range 110 is only schematically shown in FIG. 1 and indicates that the formation of a reactive species through the dielectric barrier discharge primarily takes place in the area between the electrodes 1, 3.

According to another embodiment, the first and/or second electrode(s) 1, 3 may be positioned in the dielectric element 2 in such a way that the electrodes 1, 3 are insulated from each other.

Figure 1A:
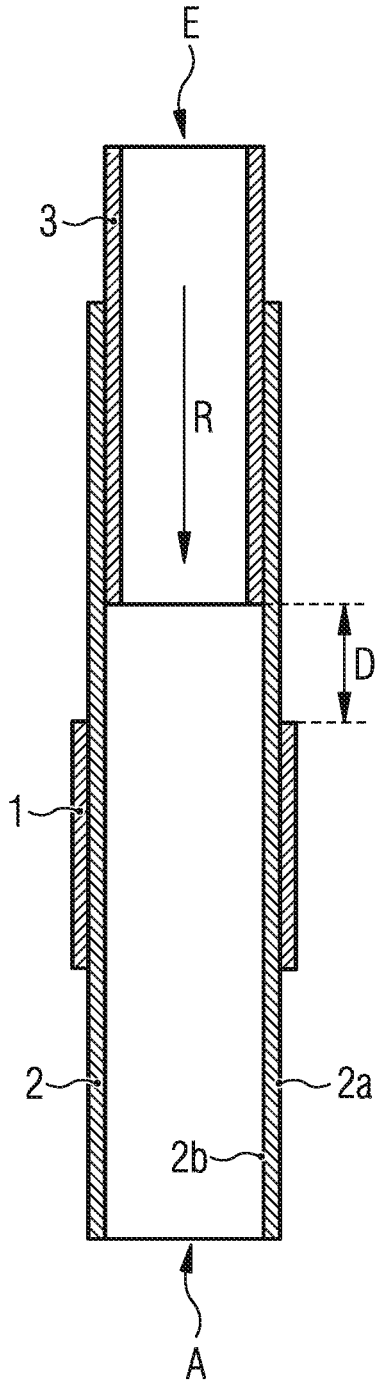
Figure 1B:
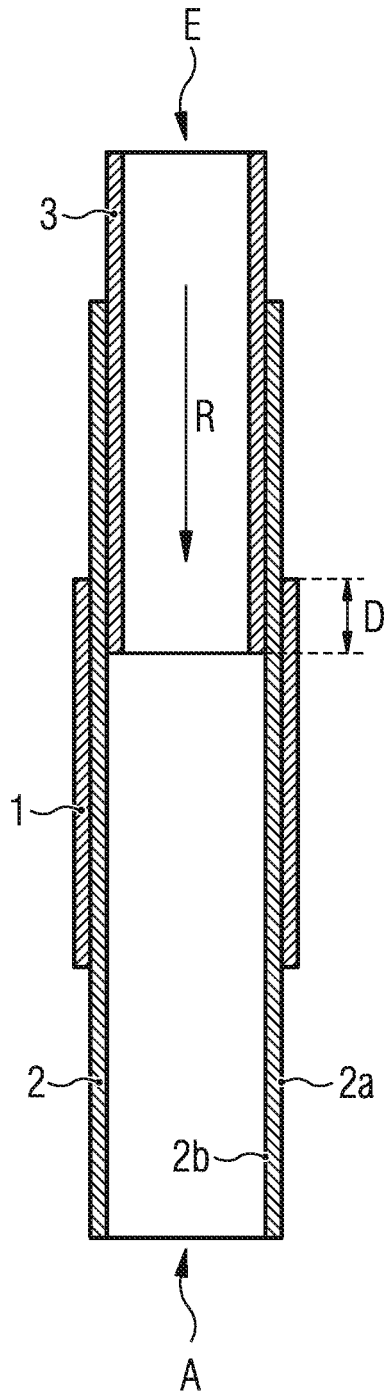
Figure 1C:
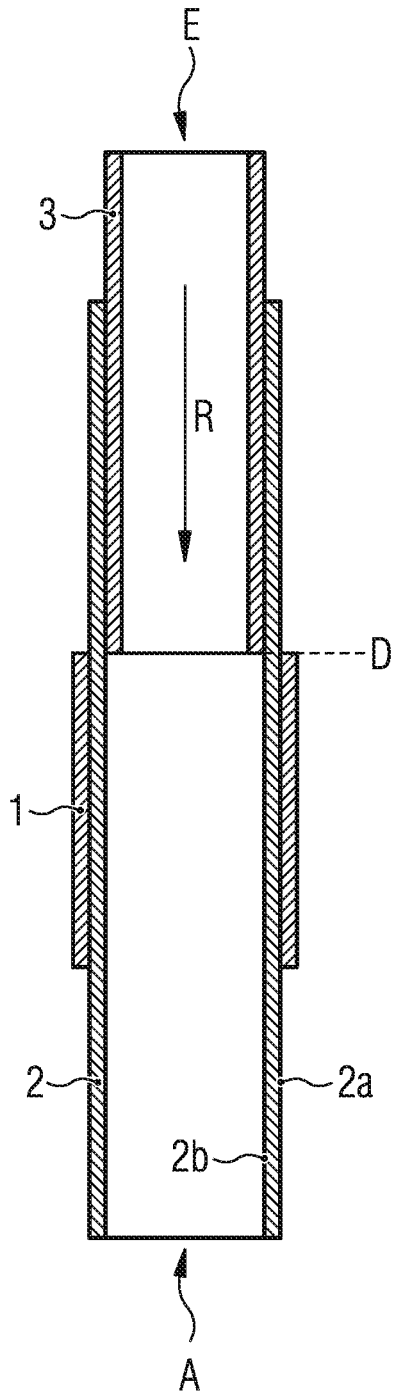

The distance D between the associated ends of the electrodes 1, 3 can be seen best in FIGS. 1*a*, 1*b* and 1*c*.

In FIG. 1*a*, the distance D has a positive value (e.g. 1 mm) and results as a distance in or against the flow direction R between the two ends of the electrodes 1, 3. The end of the first electrode 1 defining the first end in the flow direction R and the end of the second electrode 3 defining the last end in the flow direction R are associated. In the case of positive values of the distance D, the electrodes 1, 3 do not overlap in or against the flow direction R.

FIG. 1*b* shows a distance D of the associated ends of the first and second electrodes 1, 3 in or against the flow direction R with a negative value (for example −1 mm). If the electrodes 1, 3 overlap in or against the flow direction R, the end of the first electrode 1 defining the first end in the flow direction R is associated with the end of the second electrode 3 defining the last end in the flow direction R. If the electrodes 1, 3 overlap, negative values of the distance D will be obtained.

In FIG. 1*c*, the distance D between the ends of the electrodes 1, 3 is zero. The end of the first electrode 1 defining the first end in the flow direction R and the end of the second electrode 3 defining the last end in the flow direction R are associated. The person skilled in the art will be able to see that such a borderline case should only exist within the framework of the measuring accuracy of a distance measurement.

An arrangement of electrodes 1, 3 as in FIG. 1*c* provides the best results of ionization. With increasing distance D of the associated ends of the electrodes 1, 3, the efficiency of ionizing or ionization decreases, the decrease in efficiency with increasing magnitude of the negative values of the distance D being less substantial than the decrease in efficiency with increasing magnitude of positive values of the distance D.

Figure 2:
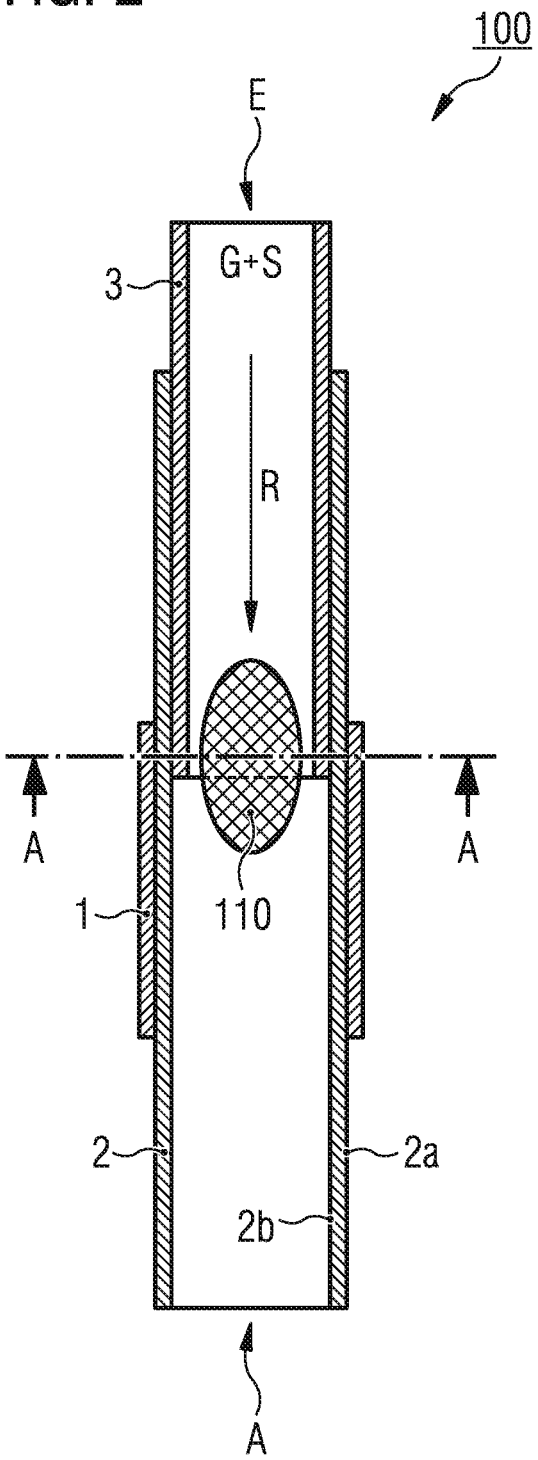
FIG. 2 shows an embodiment of an ionizing device 100 in a section through the longitudinal axis in the flow direction R with a section perpendicular to the flow direction A-A.

FIG. 2 shows an embodiment of an ionizing device 100 with overlapping electrodes 1, 3. The distance D has a negative value. A section A-A perpendicular to the direction of flow is introduced in order to show the cross-section more clearly (cf. FIG. 5).

Figure 3:
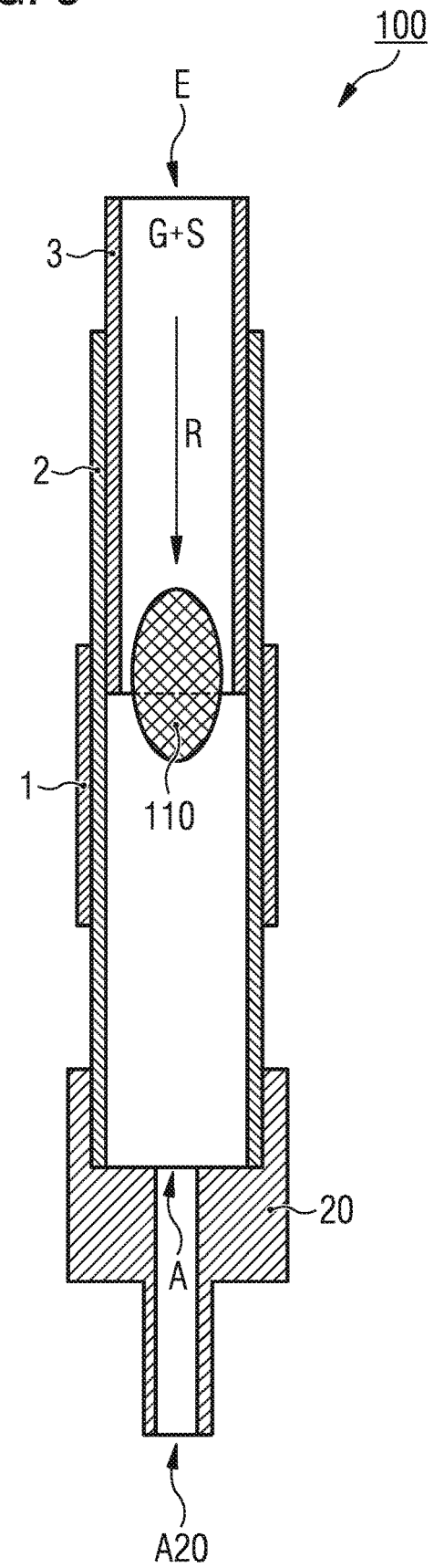
FIG. 3 shows an embodiment of an ionizing device 100 in a section through the longitudinal axis in the flow direction R with a flow limitation unit 20.

The outlet A of an ionizing device 100 has arranged thereon a flow limitation unit 20 in FIG. 3. An embodiment of the ionizing device according to FIG. 2 is exemplarily shown. A flow limitation unit 20 may also be arranged on any other embodiment of the ionizing device 100. In FIG. 3, the flow limitation unit 20 is configured as a reducer that is attachable to the ionizing device 100, whereby the flow-through area of the outlet A will be reduced. A flow through the ionizing device can be caused by a pressure gradient, for which a vacuum (established e.g. by a vacuum unit 10) is preferably applied to the outlet A of the ionizing device, the pressure prevailing outside the inlet being preferably atmospheric pressure. By reducing the cross-sectional area at the outlet A, the flow through the ionizing device 100 can easily be regulated at a given pressure gradient (e.g. by a specific vacuum at the outlet A20 of the flow limitation unit 20). When a flow limitation unit 20 and a predetermined vacuum at the outlet A20 of the flow limitation unit 20 are used, the pressure gradient in the ionizing device 100 will be low in comparison with a pressure gradient occurring without a flow limitation unit 20. Depending on the specific dimensions of the flow limitation unit 20 and of the ionizing device 100, the pressure in the dielectric barrier discharge region 110 will be significantly higher than the pressure at the outlet A20 of the flow limitation unit 20 and only slightly lower than atmospheric pressure, which preferably prevails outside the inlet E. To the person skilled in the art it will be understandable that the specific pressure conditions result from the structural design of the respective components, from material-specific characteristics and from the physical boundary conditions (temperature, ambient pressure, etc.). The absolute pressure in the dielectric barrier discharge region 110 is preferably higher than 40 kPa. The flow rate through the ionizing device 100 is preferably between 0.01 L/min and 10 L/min and particularly preferred between 0.1 L/min and 1.5 L/min.

Flow regulation by means of a reduction of the cross-sectional area can be effected not only by a flow limitation unit 20 but also by other measures taken with respect to the structural design or control technology (e.g. through a controllable change in cross-section by means of a valve or through a variable vacuum). For example, a narrowing of the outlet A of the ionizing device 100 by means of a non-constant cross-section of the dielectric element 2 may be advantageous. Other suitable measures for regulating the pressure in the ionizing device 100 and/or the flow through the ionizing device may, however, be taken.

Figure 4:
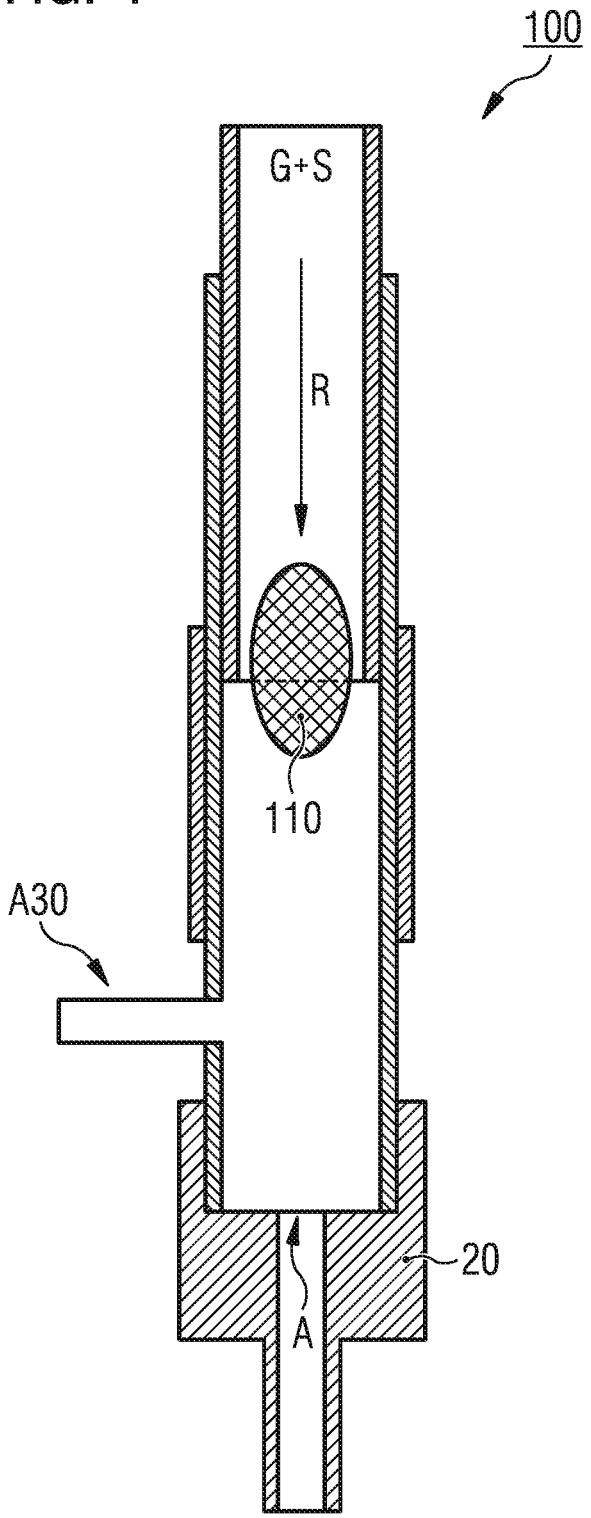
FIG. 4 shows an embodiment of an ionizing device 100 in a section through the longitudinal axis in the flow direction R with a flow limitation unit and an inlet or an outlet A30.

FIG. 4 shows a further embodiment of an ionizing device 100 with an inlet or outlet A30. The inlet or outlet A30 is combinable in all other embodiments of an ionizing device 100 according to the present invention (with or without a flow limitation unit 20). The inlet or outlet A30 is configured such that, in the flow direction R downstream or upstream of the dielectric barrier discharge region 110, an additional substance can be introduced into the ionizing device 100 or part of the flowing discharge gas G and of the sample substance S can be discharged.

Figure 5:
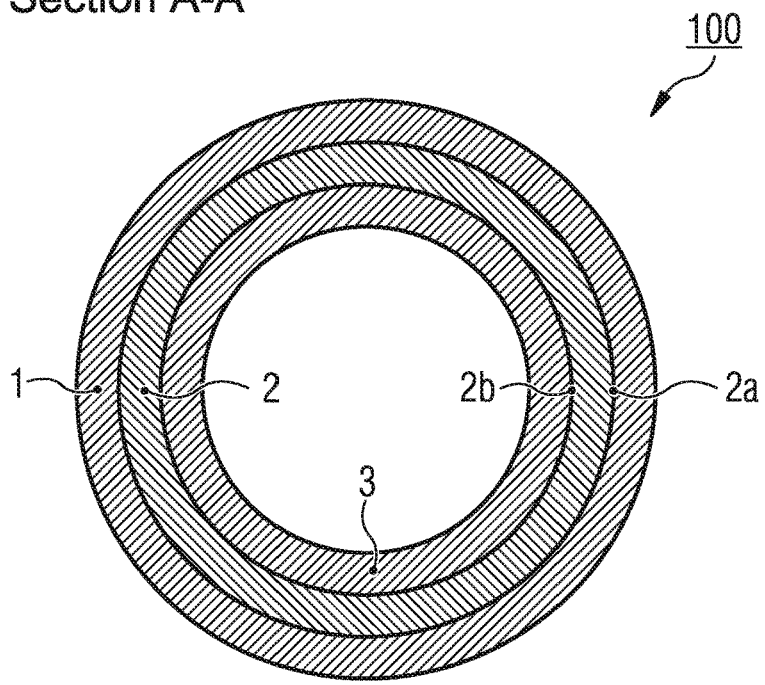
FIG. 5 shows an embodiment of an ionizing device 100 in a section A-A of the embodiment according to FIG. 2 perpendicular to the flow direction R.

FIG. 5 shows a section A-A perpendicular to the flow direction R through the part of the embodiment of an ionizing device 100 of FIG. 2 in which the electrodes 1, 3 overlap. The first electrode 1, the dielectric element 2 and the second electrode 3 have a circular cross-section. The first electrode 1 is in contact with the outer side 2*a* of the dielectric element 2, the second electrode 3 is in contact with the inner side 2*b* of the dielectric element 2. According to another embodiment, the second electrode 3 is not in contact with the inner side 2*b* of the dielectric element 2 and a discharge gas G and a sample substance S flowing through the ionizing device 100 may flow through and around the second electrode 3.

Figure 6:
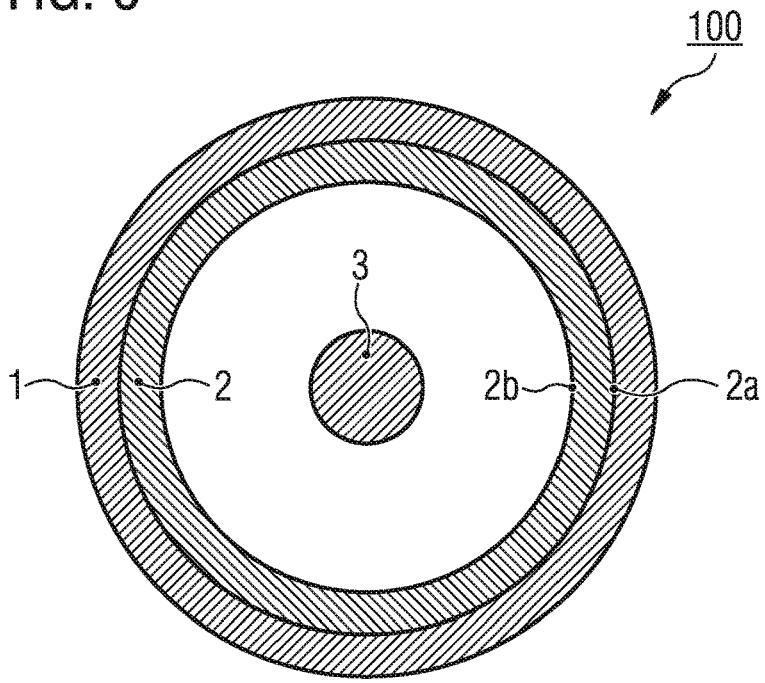
FIG. 6 shows an embodiment of an ionizing device 100 in a section perpendicular to the flow direction R.

In FIG. 6, the second electrode 3 is configured as a wire or an elongated body arranged in the central area (area perpendicular to the flow direction R) of an ionizing device 100. The inner side 2*b* of the dielectric element 2 may be contacted by a discharge gas G and a sample substance S flowing through the ionizing device 100. The first electrode 1 is in contact with the outer side 2*a* of the dielectric element 2.

Figure 7:
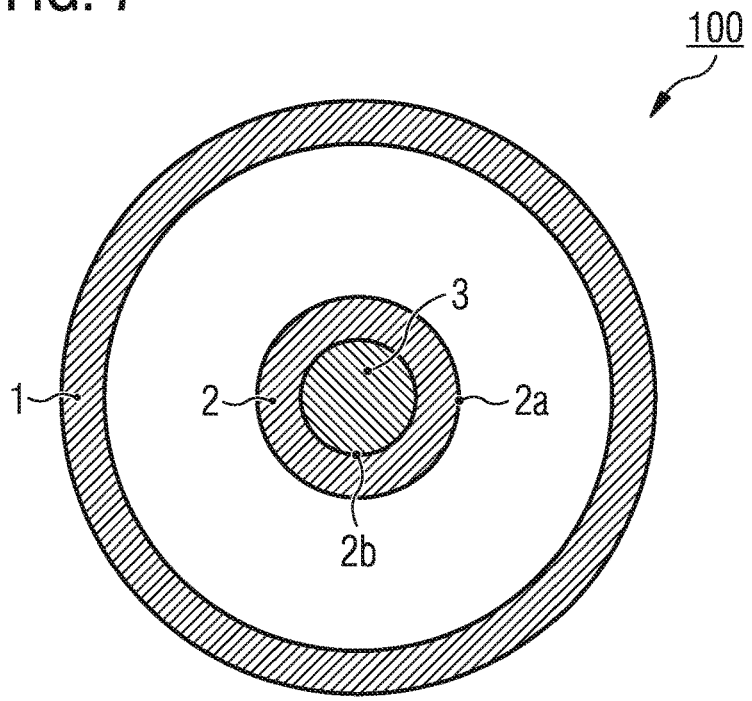
FIG. 7 shows an embodiment of an ionizing device 100 in a section perpendicular to the flow direction R.

In FIG. 7, the second electrode 3 is configured as a wire or an elongated body. The inner side 2*b* of the dielectric element 2 is in contact with the second electrode 3. A discharge gas G and a sample substance S can flow through the annular gap that forms between the dielectric element 2 and the first electrode 1.

Figure 8:
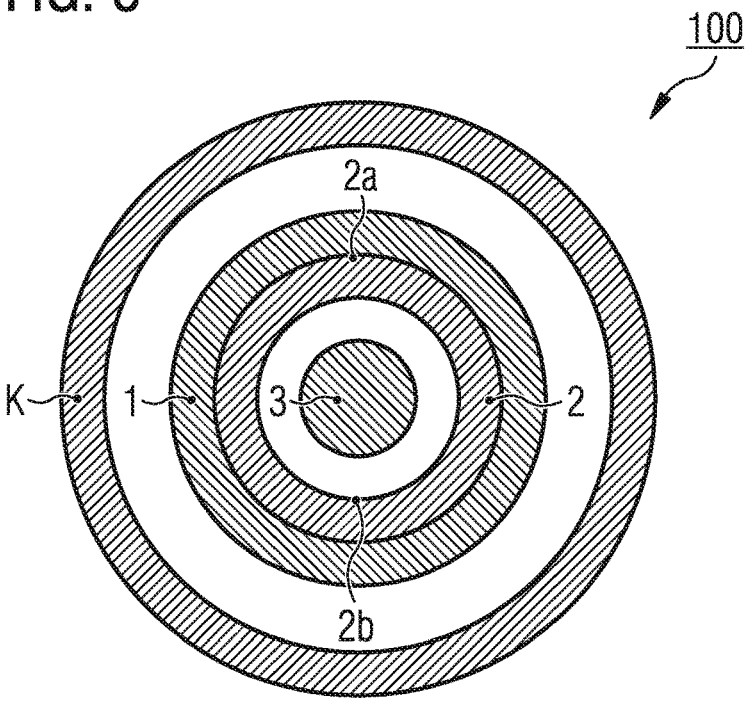
FIG. 8 shows an embodiment of an ionizing device 100 in a section perpendicular to the flow direction R.

In addition to the embodiment shown in FIG. 6, a body K is arranged around the first electrode 1 in the embodiment of the ionizing device 100 shown in FIG. 8. The second electrode 3 is configured as a wire or an elongated body and does not contact the inner side 2*b* of the dielectric element 2. The first electrode 1 is in contact with the outer side 2*a* of the dielectric element 2. The body K surrounds the first electrode 1 in such a way that a discharge gas G and a sample substance S flowing through the ionizing device 100 can be divided into two flowing parts. A first part can flow through an annular gap formed between the body K and the first electrode 1 and a second part can flow through an annular gap formed between the second electrode 3 and the dielectric element 2. The discharge gas G and the sample substance S are preferably ionizable exclusively or mainly in the annular gap between the second electrode 3 and the dielectric element 2. The dielectric barrier discharge region 110 preferably extends mainly only into the annular gap between the second electrode 3 and the dielectric element 2. The flow of the discharge gas G and of the sample substance S, which can be divided in the case of the present embodiment, is preferably dividable into the first and second parts downstream of the inlet E into the ionizing device 100 and combinable upstream (in each case seen in the flow direction R) of the outlet A of the ionizing device 100. This kind of structural design offers the possibility of ionizing only a certain part (depending on the specific dimensions of the components of the present embodiment of the ionizing device 100) of the discharge gas G and of the sample substance S, thus also reducing a minor fragmentation of ionized substances, since the part of the substances that does not flow through the dielectric barrier discharge region comes into contact with the part of the substances that has flown through the dielectric barrier discharge region during mixing of these parts, and it can be ionized e.g. by charge transfer reactions.

Figure 9:
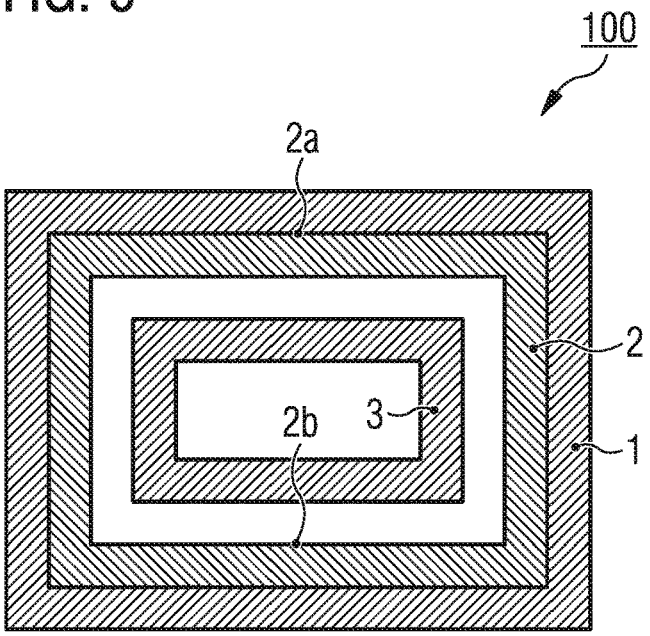
FIG. 9 shows an embodiment of an ionizing device 100 in a section perpendicular to the flow direction R.

An embodiment of the ionizing device 100 in FIG. 9 comprises a first electrode 1, a dielectric element 2 and a second electrode 3, which have a rectangular basic shape. The second electrode 3 is surrounded by the sides of the dielectric element 2 (inner side 2*b*) and a discharge gas G as well as a sample substance S can flow therethrough and therearound. The first electrode 1 is in contact with the outer side 2*a* of the dielectric element 2.

Figure 10:
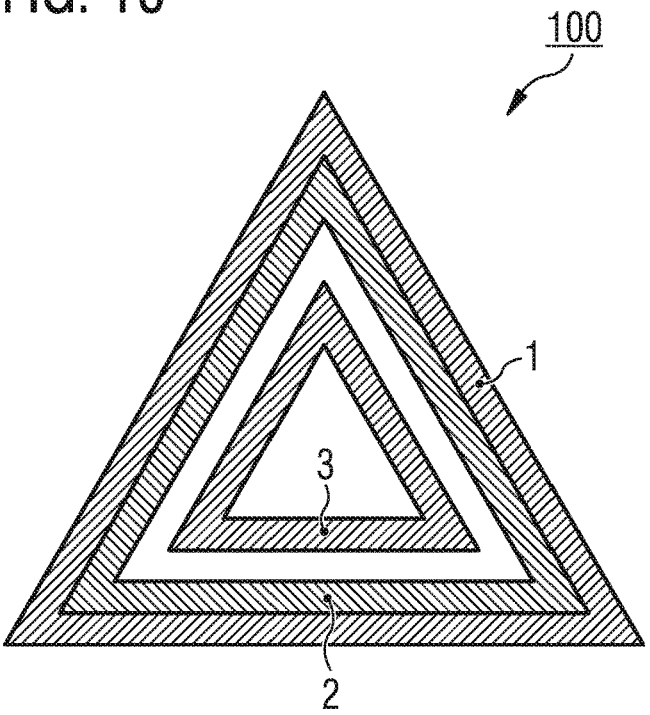
FIG. 10 shows an embodiment of an ionizing device 100 in a section perpendicular to the flow direction R.

The first electrode 1, the dielectric element 2 and the second electrode 3 of the embodiment of the ionizing device 100 shown in FIG. 10 have a triangular basic shape and are otherwise configured analogously to the embodiment of FIG. 9. In the case of basic geometric shapes having more than one side (for example triangles, other polygonal shapes or other basic shapes), internal sides are summarized as an inner side and external sides as an outer side.

In other embodiments, various polygonal, elliptical and other basic shapes may be advantageous.

All the cross-sections of FIGS. 5 to 10 may be cross-sections of the various embodiments of the ionizing device 100 disclosed here.

An analyzer 200 shown in FIG. 11 comprises an arbitrary embodiment of the ionizing device 100, which is connected to an analysis unit 30. The connection between the ionizing device 100 and the analysis unit 30 may be configured in different ways. For example, a direct connection (the ionizing device 100 merges directly with the analysis unit 30) may be formed, or an intermediate or transition piece may be arranged between the ionizing device 100 and the analysis unit 30. When a discharge gas G and a sample substance S flow through the ionizing device 100, the discharge gas G and the sample substance S can be ionized. When the ionized discharge gas G and the ionized sample substance S enter the analysis unit 30, the ionized sample substance S can be analyzed. In principle, any analysis unit that is capable of analyzing a property of a charged sample substance is suitable for use as an analysis unit 30. An analysis unit 30 may e.g. be a mass spectrometer, an ion mobility spectrometer or some other unit known as such. Also an analyzer 200 may have attached thereto a vacuum unit 10.

The invention claimed is:

1. A method of flow-through ionization of a discharge gas and of a sample substance in an ionization device at an absolute pressure of more than 40 kPa in the ionizing device, during ionization, the ionizing device comprising an inlet, an outlet, a first electrode, a dielectric element and a second electrode, wherein:

(a) the dielectric element is configured in the shape of a hollow body having an inner side and an outer side, and the discharge gas and the sample substance flow therethrough in a flow direction;

(b) the first electrode is arranged outside of the outer side of the dielectric element;

(c) the second electrode is arranged, at least sectionwise, inside the dielectric element, is surrounded by the inner side of the dielectric element perpendicularly to the flow direction, and the discharge gas and the sample substance flow therethrough or therearound;

(d) a distance in or contrary to the flow direction between the associated ends of the first and second electrodes lies between −5 mm and 5 mm;

(e) a dielectric barrier discharge is established in a dielectric barrier discharge region by applying a voltage between the first and second electrodes so as to ionize the discharge gas or the sample substance.

2. The method according to claim 1, wherein the pressure in the ionizing device is higher than 60 kPa, preferably higher than 80 kPa and is particularly preferred essentially atmospheric pressure.

3. The method according to claim 1, wherein the distance between the associated ends of the first and second electrodes lies between −3 mm and 3 mm, preferably between −1 mm and 1 mm, more preferably between −0.2 mm and 0.2 mm and most preferably between −0.05 mm and 0.05 mm.

4. The method according to claim 1, wherein the second electrode has the shape of a hollow cylinder, the shape of a longitudinally extending hollow body with a triangular, rectangular or oval basic shape, or is a wire.

5. The method according to claim 1, wherein the outer side of the second electrode is spaced apart from the inner side of the dielectric element at a distance of less than 0.5 mm, preferably less than 0.1 mm, and is preferably in contact with the inner side of the dielectric element.

6. The method according to claim 1, wherein the first electrode is substantially in contact with the outer side of the dielectric element and is preferably configured as a layer applied through a drying or curing liquid or suspension or is applied through a transition from a vapor phase into a solid phase.

7. The method according to claim 1, wherein the flow-through area of the outlet of the ionizing device is smaller than or equal to the area of the inlet of the ionizing device, and the outlet of the ionizing device has preferably arranged thereon a flow limitation unit.

8. The method according to claim 1, wherein a pressure gradient inside the ionizing device causes a flow with the flow direction in the ionizing device, preferably through a vacuum at the outlet and an essentially atmospheric pressure directly outside the inlet.

9. An ionizing device for flow-through ionization, comprising an inlet, an outlet, a first electrode, a dielectric element and a second electrode, wherein:

(a) the dielectric element is configured in the shape of a hollow body having an inner side and an outer side, and allows a flow of a discharge gas and of a sample substance therethrough in a flow direction;

(b) the first electrode is arranged outside of the outer side of the dielectric element;

(c) the second electrode is arranged, at least sectionwise, inside the dielectric element, is surrounded by the inner side of the dielectric element perpendicularly to the flow direction, and allows a flow of the discharge gas and of the sample substance therethrough or therearound;

(d) a distance in or contrary to the flow direction between the associated ends of the first and second electrodes lies between −5 mm and 5 mm;

(e) a dielectric barrier discharge is establishable in a dielectric barrier discharge region by applying a voltage between the first and second electrodes so as to ionize the discharge gas or the sample substance; and (f) the absolute pressure in the ionizing device during an ionization is higher than 40 kPa.

10. The ionizing device according to claim 9, wherein the pressure in the ionizing device is higher than 60 kPa, preferably higher than 80 kPa and is particularly preferred essentially atmospheric pressure.

11. The ionizing device according to claim 9, wherein the distance between the associated ends of the first and second electrodes lies between −3 mm and 3 mm, preferably between −1 mm and 1 mm, more preferably between −0.2 mm and 0.2 mm and most preferably between −0.05 mm and 0.05 mm.

12. The ionizing device according to claim 9, wherein the second electrode has the shape of a hollow cylinder, the shape of a longitudinally extending hollow body with a triangular, rectangular or oval basic shape, or is a wire.

13. The ionizing device according to claim 9, wherein the outer side of the second electrode is spaced apart from the inner side of the dielectric element at a distance of less than 0.5 mm, preferably less than 0.1 mm, and is preferably in contact with the inner side of the dielectric element.

14. The ionizing device according to claim 9, wherein the first electrode is substantially in contact with the outer side of the dielectric element and is preferably configured as a layer applied through a drying or curing liquid or suspension or is applied through a transition from a vapor phase into a solid phase.

15. The ionizing device according to claim 9, wherein the flow-through area of the outlet of the ionizing device is smaller than or equal to the area of the inlet of the ionizing device, and the outlet of the ionizing device has preferably arranged thereon a flow limitation unit.

16. The ionizing device according to claim 9, wherein a pressure gradient inside the ionizing device causes a flow with the flow direction in the ionizing device, preferably through a vacuum at the outlet and an essentially atmospheric pressure directly outside the inlet.

17. An analyzer for analyzing a sample substance in a discharge gas, comprising the ionizing device according to claim 9 and an analysis unit, the analysis unit being connected to the ionizing device.

18. The analyzer according to claim 17, wherein, in addition to the ionizing device, at least one further ionizing device is arranged.

19. The analyzer according to claim 17, wherein the inlet of the ionizing device is open to the surroundings and the discharge gas is preferably the atmosphere surrounding the inlet.

20. The method according to claim 1, wherein the applied voltage is not higher than 20 kV, preferably not higher than 10 kV, more preferably not higher than 5 kV and most preferably a voltage between 1 kV and 3 kV.

21. The method according to claim 1, wherein the dielectric barrier discharge is caused by unipolar high-voltage pulses having preferably a pulse duration of not more than 1 μs, particularly preferred not more than 500 ns, and most preferred a duration between 100 ns and 350 ns.

22. The method according to claim 21, wherein the high-voltage pulses have a frequency that is not higher than 1 MHz, preferably not higher than 100 kHz, more preferably not higher than 25 kHz and most preferably a frequency between 1 kHz and 15 kHz.

23. The method according to claim 1, wherein the first and second electrodes are supplied with a sine-wave voltage, the sine-wave voltages of one electrode being preferably shifted by half a period relative to the other electrode.

24. The method according to claim 1, wherein the discharge gas flows through the ionizing device and the ionized discharge gas flows to the sample substance outside the ionizing device, the sample substance and the ionized discharge gas being jointly suppliable to an analyzer.

* * * * *